US006688131B1

(12) United States Patent
Kim et al.

(10) Patent No.: US 6,688,131 B1
(45) Date of Patent: Feb. 10, 2004

(54) ICE MAKING MACHINE

(75) Inventors: Oh-bok Kim, Gwangju (KR); Tae-yun Jung, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/420,483

(22) Filed: Apr. 22, 2003

(30) Foreign Application Priority Data

Oct. 31, 2002 (KR) ..... 10-2002-0066737

(51) Int. Cl.[7] ..... F25C 1/14
(52) U.S. Cl. ..... 62/353; 62/69
(58) Field of Search ..... 62/69, 70, 352, 62/353, 68

(56) References Cited

U.S. PATENT DOCUMENTS 2,133,521 A * 10/1938 Wussow et al. ..... 62/67
4,217,762 A * 8/1980 Sakamoto et al. ..... 62/132
6,619,050 B2 * 9/2003 Hozumi et al. ..... 62/70

* cited by examiner

*Primary Examiner*—William E. Tapolcai
(74) *Attorney, Agent, or Firm*—Ladas & Parry

(57) ABSTRACT

An ice making machine comprising a housing, an evaporator connected to a freezing system, a base frame having a multiplicity of freezing cells for receiving water to be frozen, a freezing base plate provided with the evaporator and having freezing fingers formed on the lower surface of to be dipped into the multiplicity of freezing cells retaining the water to be frozen, and an air removing means circulating the water around the freezing fingers for removing air bubbles inside the water. The air removing means may comprise a multiplicity of nozzles spraying air onto the water contained in the freezing cells.

3 Claims, 5 Drawing Sheets

ICE MAKING MACHINE

BACKGROUND OF THE INVENTION

1. Field of the Invention

The present invention relates generally to an ice making machine, and more particularly, to an ice making machine enabled to reduce ice making time and to minimize the amount of water being wasted.

2. Description of the Prior Art

An ice making machine is an apparatus for making pieces of ice by freezing water supplied from an external water supply. More recently, ice making machines enabled to prevent opacification of ice pieces, which occurs as air bubbles inside the water are frozen, has been proposed.

FIGS. 1 and 2 show a conventional ice making machine disclosed in U.S. Pat. No. 5,425,243. The conventional ice making machine as shown in FIGS. 1 and 2 comprises a housing 10, a freezing unit 20, and an air removing means 30.

The housing 10 of the ice making machine comprises an ice bin 11 for storing ice pieces produced in the freezing unit 20. A compressor 12 and a condenser 13 are disposed below the ice bin 11.

The freezing unit 20 comprises a water tray 21, a freezing base plate 22, and an evaporator 23 as shown in FIG. 2. The water tray 21 is filled with water and a multiplicity of freezing fingers 24 are formed on the lower surface of the freezing base plate 22 for being dipped in the water so as to freeze it. A pivoting means 25 is disposed at one side of the water tray 21 for tilting the water tray 21 and discharging the water that does not freeze to form ice pieces. The evaporator 23 is disposed on the upper surface of the freezing base plate 22 and is connected with a freezing system. Refrigerant flows inside the evaporator 23 and the freezing base plate 22 and the freezing fingers 24 are cooled by the heat exchange of the refrigerant.

The air removing means 30 is provided for preventing opacification from occurring during the ice making process by removing air bubbles in the water to be frozen. The air removing means 30 comprises a rocking plate 31 that can rock up and down inside the water tray 21, and a rocking motor 32 for rocking the rocking plate 31. When an engagement piece 33 disposed in the rocking motor 32 hits an engagement pin 34, the rocking plate 31 rocks, thereby floating the air bubbles upwardly and outside the water.

The freezing unit 20 further comprises a water supply pipe 14, a pivotal shaft 26, a water chute 27, and a water collecting section 15.

Hereinafter, the operation is described of a conventional ice making machine having the above-described structure.

When the water is supplied to the water tray 21 through the water supply pipe 14 and the freezing fingers 24 are dipped into the water, the water starts to form ice around the freezing fingers 24, which are cooled below the freezing point by heat exchange of the refrigerant flowing inside the evaporator 23. At the same time, the rocking plate 31 under the water rocks up and down as the rocking motor 32 is driven. Accordingly, the air bubbles inside the water are removed and clear ice pieces are gradually formed around the freezing fingers 24.

After the ice pieces formed around the freezing fingers 24 reach a predetermined size, the rocking plate 31 stops rocking, and hot gas is discharged from the compressor 12, without passing through the condenser 13, directly into the evaporator 23, thereby warming the freezing fingers 24. The water tray 21 is tilted on the pivotal shaft 26 by the pivoting means 25. Therefore, the ice pieces are separated off the freezing fingers 24 and drop into the ice bin 11, and the water remaining in the water tray 21 is discharged into the water collecting section 15.

Such conventional ice making machines require an amount of water exceeding what is actually needed to be frozen as the water tray is designed to hold more than the amount of water necessary to make ice pieces, thereby wasting a lot of water.

Moreover, since the freezing fingers 24 cool not only the water to be frozen but also all of the water in the water tray 21, excessive energy is consumed and it takes too long to freeze the water around the freezing fingers 24.

SUMMARY OF THE INVENTION

An object of the invention is to solve at least the above problems and/or disadvantages and to provide at least the advantages described hereinafter.

Accordingly, an object of the present invention is to solve the foregoing problems by providing an ice making machine enabled to minimize the waste of water by supplying a predetermined amount of water into a multiplicity of freezing cells formed having a predetermined size and to shorten the time required to form ice pieces by increasing the freezing speed around the freezing fingers.

In order to achieve the above objective, the ice making machine according to the present invention comprises a housing, an evaporator connected to a freezing system, a base frame having a multiplicity of freezing cells for receiving water to be frozen, a freezing base plate provided with the evaporator and having freezing fingers formed on the lower surface of to be dipped into the space defined by the multiplicity of freezing cells in which water to be frozen has been introduced, and an air removing means circulating the water around the freezing fingers for removing air bubbles inside the water.

The air removing means preferably comprises a multiplicity of nozzles spraying air onto the water contained in the freezing cells.

The nozzles are disposed in grooves directed in a tangent to the rims of the freezing cells.

BRIEF DESCRIPTION OF THE DRAWINGS

The above object and the feature of the present invention will be made more apparent by describing a preferred embodiment of the present invention with reference to the accompanying drawings, in which.

DETAILED DESCRIPTION OF THE PREFERRED EMBODIMENT

Figure 1:
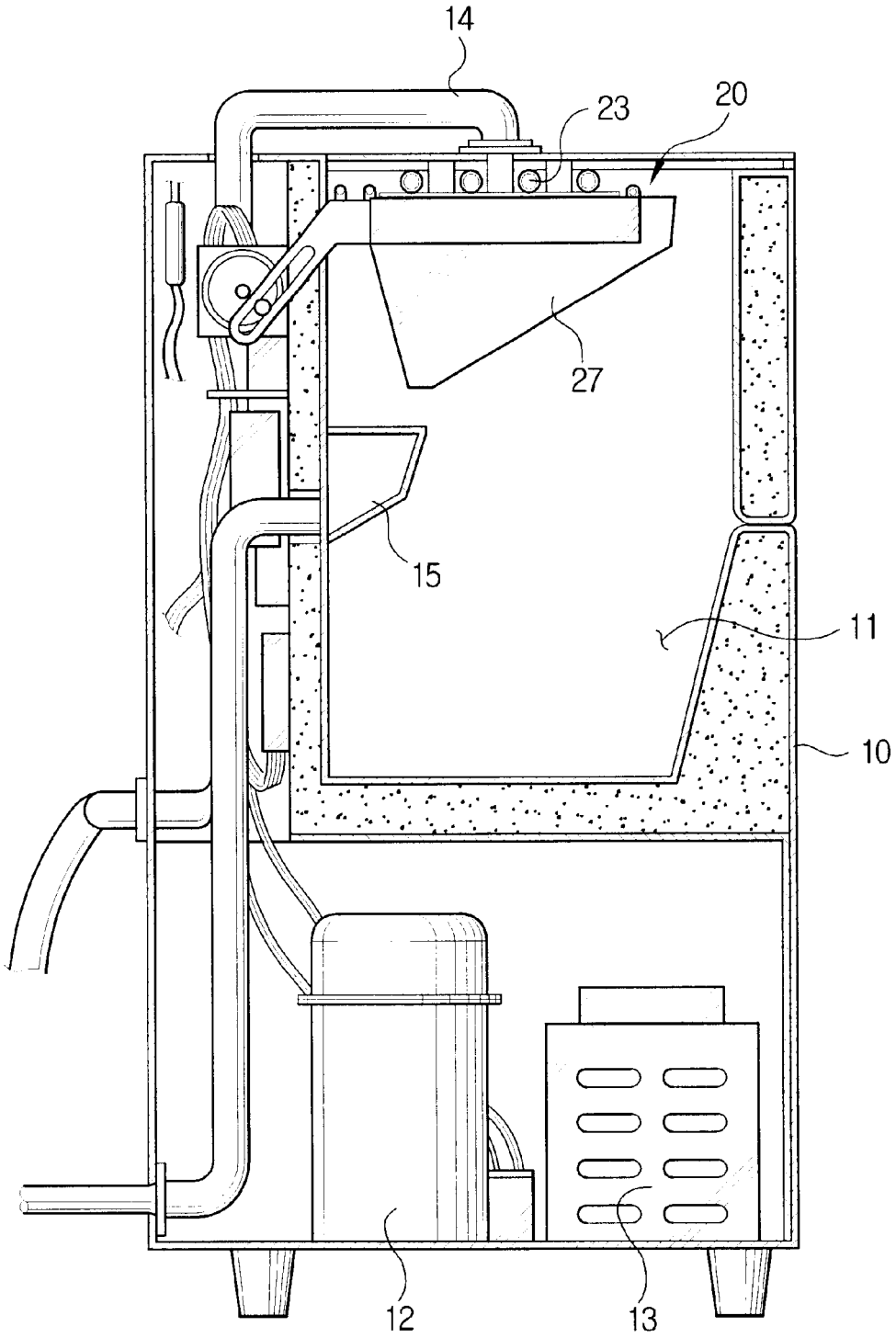
FIG. 1 (PRIOR ART)
FIG. 1 is a cross-sectional view showing the structure of a conventional ice making machine.
Figure 2:
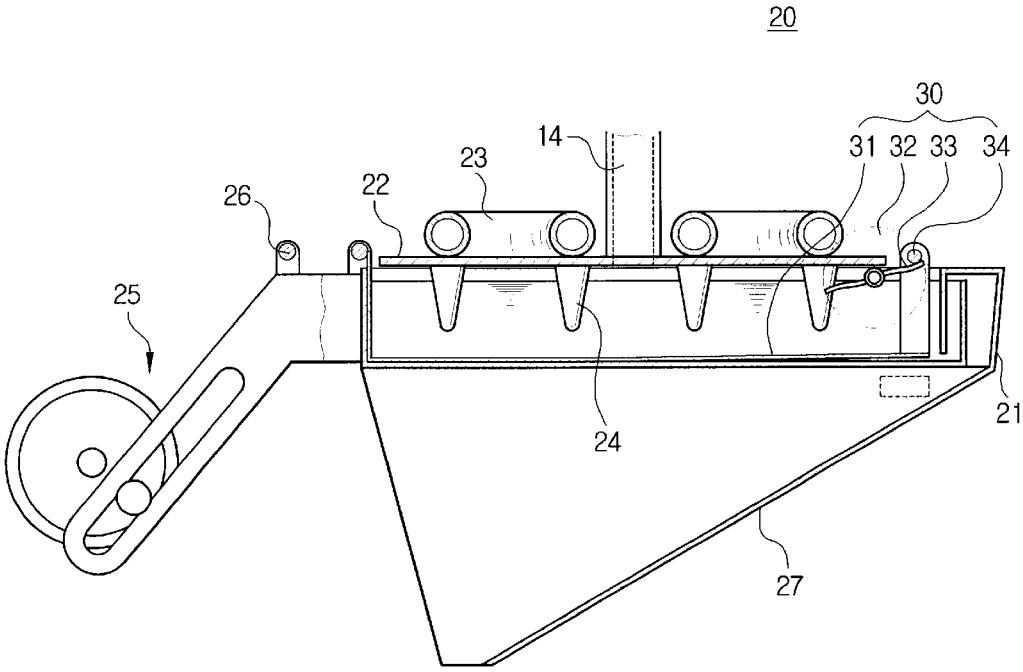
FIG.2 (PRIOR ART)
FIG. 2 is a side detail view showing a part of the essential structure shown in FIG. 1.

Hereinafter, an ice-making machine according to a preferred embodiment of the present invention will be described in greater detail with reference to the accompanying drawings. Those elements that are similar or identical to those of the above-described prior art will have like reference numerals assigned thereto.

Figure 3:
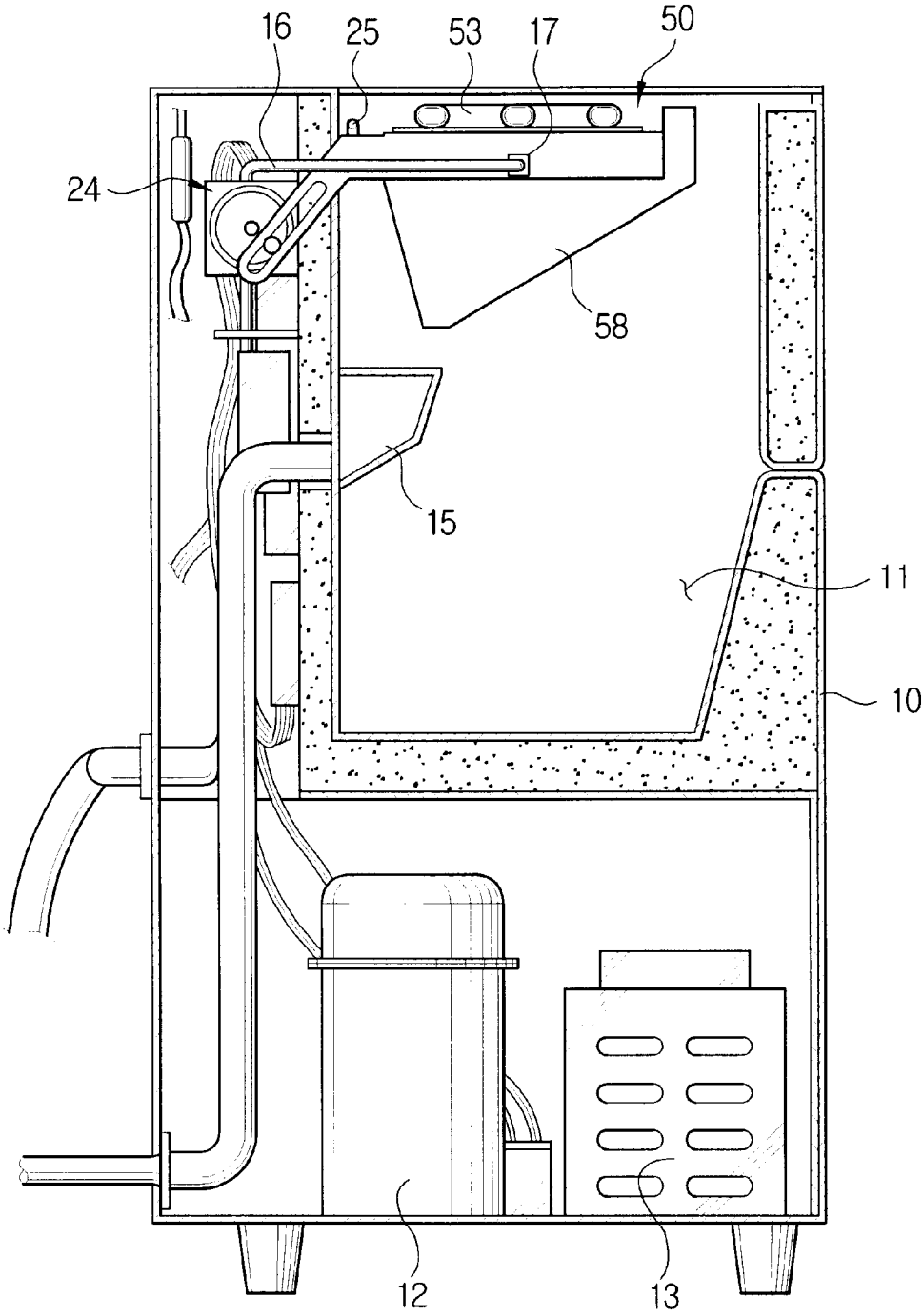
FIG. 3 (is a cross-sectional view showing the structure of an ice making machine according to a preferred embodiment of the present invention.
Figure 4:
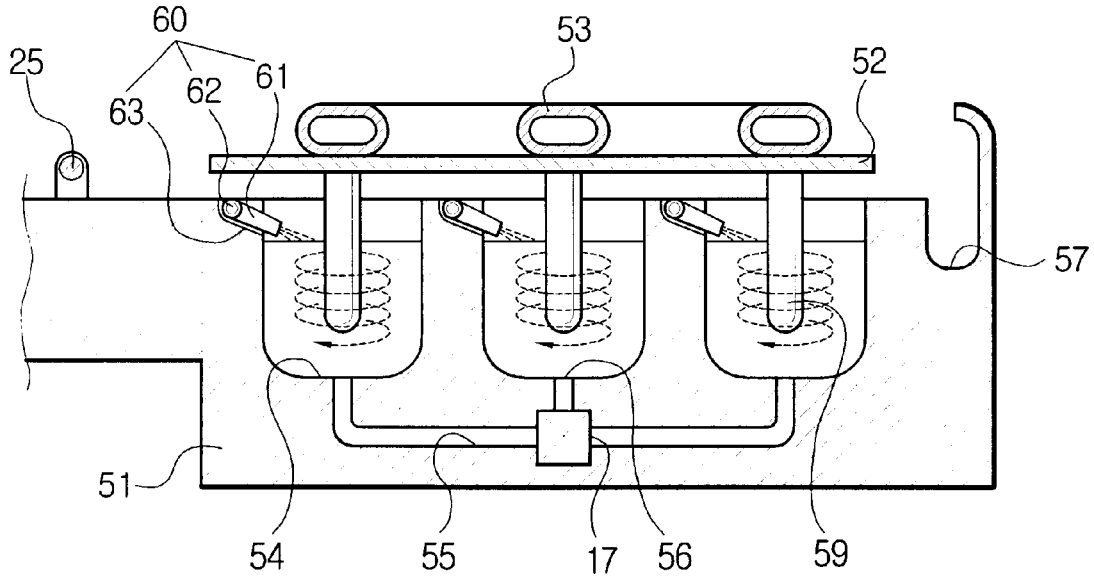
FIG. 4 is a cross-sectional detail view showing a part of the essential structure shown in FIG. 3.
Figure 5:
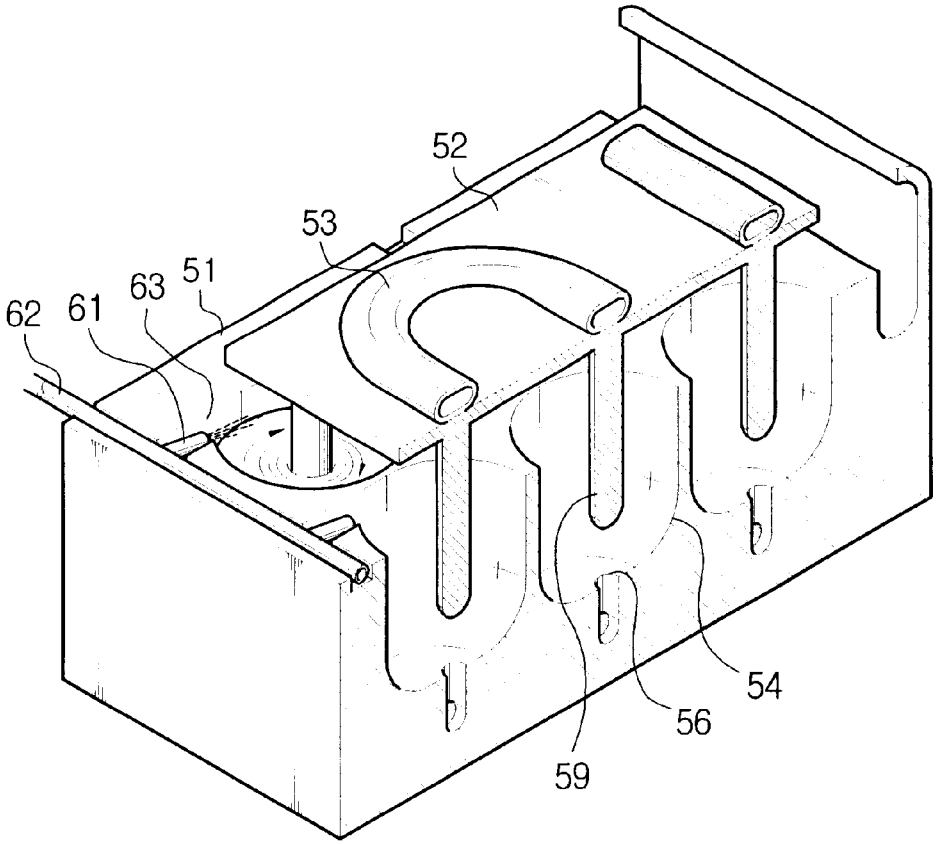
FIG. 5 is a partially cut-away, perspective view showing essential parts of the device shown in FIG. 3.

As shown in FIGS. 3 through 5, the ice making machine according to the present invention comprises a housing 10, a freezing unit 50, and an air removing means 60.

The housing 10 has an ice bin 11 for storing ice pieces produced by the freezing unit 50. A compressor 12 and a condenser 13, comprising a freezing system, are disposed below the ice bin 11 and a water collecting section 15 is disposed at a side of the ice bin 11 for discharging the water that is not frozen.

The freezing unit 50 comprises a base frame 51 and a freezing base plate 52, and an evaporator 53. The base frame 51 is pivotably disposed on the housing 10 and has a multiplicity of freezing cells 54 for receiving water that flows through a water path 55, provided for supplying water into the freezing cells 54. The freezing cells 54 are formed having a predetermined size, taking into consideration the desired size of the ice pieces and the water freezing speed, and the number of freezing cells may range between 20 and 30, and preferably numbers 27. The water path 55 is connected with the water supply pipe 16, as shown in FIG. 3. Between the water path 55 and the water supply pipe 16, is provided a valve 17 for controlling the introduction of the water supply. When the valve 17 is opened, the water of the water supply pipe 16 can flow into the water path 55 and the water flowing through the water path 55 is supplied into the freezing cells 54 through inlet holes 56 formed under each freezing cell 54. At a side of the base frame 51, a drain path 57 is formed. When the base frame 51 is tilted at a predetermined angle on a pivotal shaft 25 by a pivoting means 24, the water in the freezing cell 54, which is not frozen flows into a water chute 58 along the drain path 57 and is discharged into the water collecting section 15.

The freezing base plate 52 is disposed under the evaporator 53 and the freezing fingers 59 are dipped into the water supplied in the freezing cells 54, which freezing fingers 59 are disposed under the freezing base plate 52. The evaporator 53 is connected in fluid communication with the freezing system, allowing refrigerant to flow therein. The freezing fingers 59 are cooled to a temperature below the freezing point by heat exchange of the refrigerant flowing inside the evaporator 53 and ice pieces are gradually formed around the freezing fingers 59.

The air removing means 60 comprises a multiplicity of nozzles 61 and an air pipe 62. The nozzles 61 are disposed in grooves 63 and are directed in a tangent to the rims of the freezing cells 54 and tilted downwardly. Each nozzle 61 is connected with the air pipe 62 and the air is sprayed from the nozzle 61 onto the surface of the water in the freezing cell 54 thereby to circulate the water. The air pipe 62 is connected with a device generating spray air such as an air compressor (not shown) or a blower (not shown).

Hereinafter, an operation of an ice making machine according to the present invention is described.

When the valve 17 disposed at the end of the water supply path 16 is opened, the water flows into each freezing cell 54 through the water path 55. After a predetermined amount of water is supplied, the valve 17 prevents water from flowing into the water path 55, thereby maintaining a predetermined level of water in the freezing cells 54.

After the water supply operation is completed, the water around the freezing fingers 59 is cooled below the freezing point by heat exchange of the refrigerant inside the evaporator and starts to form ice. At the same time, the air inside the air pipe 62 is sprayed through the nozzles 61 onto the water. The air sprayed from the nozzles 61 circulates the water around the freezing fingers 59 and the air bubbles on the inner surface of the freezing cells 54 float upwardly to the surface. Therefore, the water without the air bubbles freezes around the freezing fingers 59, thereby forming clear ice pieces.

When ice pieces having a predetermined size are formed around the freezing fingers 59, the air spray through the nozzles 61 is stopped and the base frame 51 is tilted by the pivoting means 24 around the pivotal shaft 25. When the base frame 51 is tilted to one side, the water on the freezing cells 54 that has not been frozen is guided to the water chute 58 along the drain path 57 and is discharged to the water collecting section 15. Hot gas from the compressor 12 bypasses the condenser 13 and flows directly to the evaporator 53. Accordingly, the freezing fingers 59 are warmed up to around 10° C., thereby allowing the ice pieces to be separated from off the freezing fingers 59 and dropped into the ice bin 11.

According to the present invention in which a predetermined amount of water is supplied into a multiplicity of freezing cells 54 formed in a predetermined size, the amount of water supplied for ice making can be reduced compared to the conventional ice making machine, thereby preventing water from being wasted.

Another advantage of the present invention is that the freezing speed around the freezing fingers 59 can be improved, thus reducing ice making time as the freezing fingers 59 are cooled below the freezing point and dipped into a predetermined amount of water carried in the freezing cells 54.

The foregoing embodiments and advantages are merely exemplary and are not to be construed as limiting the present invention. The present teaching can be readily applied to other types of apparatus. The description of the present invention is intended to be illustrative, and not to limit the scope of the following claims. Many alternatives, modifications, and variations will become apparent to those skilled in the art. In the claims, means-plus-function clauses are intended to cover the structures described herein as performing the recited function and not only structural equivalents but also equivalent structures.

What is claimed is:

1. An ice making machine comprising:

a housing;

an evaporator connected to a freezing system;

a base frame having a multiplicity of freezing cells for receiving water to be frozen;

a freezing base plate provided with the evaporator and having freezing fingers formed on the lower surface thereof to be dipped into the space defined by the multiplicity of freezing cells in which water to be frozen has been introduced; and an air removing means circulating the water around the freezing fingers for removing air bubbles inside the water.

2. The ice making machine according to claim 1, wherein the air removing means comprises a multiplicity of nozzles each spraying air onto the water contained in the freezing cells.

3. The ice making machine according to claim 2 wherein the nozzles are disposed in grooves directed in a tangent to rims of the freezing cells.

* * * * *